US006094763A

United States Patent [19]

Engel

[11] Patent Number: 6,094,763

[45] Date of Patent: Aug. 1, 2000

[54] METHOD AND DEVICE FOR UNLOADING ITEMS OF WASHING FROM A TREATMENT MACHINE

[76] Inventor: Gerhard Engel, Weststrasse 12, D-74363 Gueglingen, Germany

[21] Appl. No.: 09/202,975

[22] PCT Filed: Jun. 10, 1997

[86] PCT No.: PCT/EP97/03017

§ 371 Date: Jan. 27, 1999

§ 102(e) Date: Jan. 27, 1999

[87] PCT Pub. No.: WO98/00598

PCT Pub. Date: Jan. 8, 1998

[30] Foreign Application Priority Data

Jun. 27, 1996 [DE] Germany ..... 196 25 707

[51] Int. Cl.[7] ..... D06F 39/00; F26B 25/00

[52] U.S. Cl. ..... 8/159; 34/58; 34/236; 34/322; 34/328; 34/361; 34/380; 68/210

[58] Field of Search ..... 8/159; 68/210; 34/236, 58, 322, 328, 361, 362, 367, 380

[56] References Cited

U.S. PATENT DOCUMENTS 4,285,219 8/1981 Grunewald ..... 68/210 X 5,060,399 10/1991 Engel ..... 34/236 X

FOREIGN PATENT DOCUMENTS 0343096 11/1989 European Pat. Off. .

1915990 10/1970 Germany .

467954 6/1937 United Kingdom ..... 68/210

*Primary Examiner*—Philip R. Coe

*Attorney, Agent, or Firm*—Foley & Lardner

[57] ABSTRACT

In the method for unloading items of laundry from a spin-dryer or washer-dryer (20) which has a perforated operating drum (21) and a drum housing (22) with an end-side unloading opening (26) which can be closed by means of a door (27), after the spin-drying process is finished, the operating drum (21) is set to a speed at which the centrifugal force acting on the items of laundry is still somewhat greater than the force of gravity. The door (27) of the drum housing (22) is opened. The pipe of a suction conveying system is connected to the unloading opening (26) of the drum housing (22). The suction conveying system is activated, and on the drum housing (22) the closure member (29) of an air inlet opening, which is arranged on the peripheral wall, is opened. The method can also be used analogously in tumble-dryers. The device for carrying out the method has the device parts mentioned.

29 Claims, 8 Drawing Sheets

39
38
43
41
42

41
29
28
42
27
39
43

39
38
28
41
29
39.2
21
22
43
42
39.1

70
92
94
93
76
77
78
78

70
89
88
92
94
81
76
73
74
93
75
72
71
78
82
83
84
85
79

70
83
79
77
75

METHOD AND DEVICE FOR UNLOADING ITEMS OF WASHING FROM A TREATMENT MACHINE

When items of laundry of the most varied type are being washed or cleaned, the washing dentro de la zona 34 or cleaning process is generally followed by a further number of treatment cycles, such as, for example, spin-drying, drying, ironing, stacking and the like. This also applies to items of laundry which after being washed are pressed dry in a drying press, for which purpose the very compact bundle of laundry first has to be separated before the items of laundry can be treated further.

Items of laundry are understood here as being all types of textile and nontextile articles which are washed, cleaned, spun dry, dried and otherwise further treated, such as, for example, underwear, shirts, trousers, dresses, overalls, aprons, bed linen, but also cloths, mops, rubber gloves, loose plastic covers and the like.

In each of the abovementioned treatment stations the items of laundry have to be removed from the machine after the treatment process concerned is finished, i.e. the machine has to be unloaded so that the items of laundry can be transported to the next treatment station. For this purpose, the items of laundry are generally removed by hand from the treatment machine concerned and placed into a transporting container or placed onto a transporting device and transported thereby to the next treatment station. This is relatively laborious and time-consuming and requires expensive transporting means and transporting devices which, moreover, are susceptible to mishaps and wear and require a correspondingly high outlay on maintenance. When soft items of laundry, for example cotton underwear, are being processed, a further additional disadvantage frequently occurs during the spin-drying in that, at high spin-drying speeds, parts of the items of laundry resting directly against the perforated peripheral wall of the operating drum are pressed into the nozzle-shaped perforations and sometimes even emerge outside the latter and relax again, i.e. swell up somewhat, outside the perforation. The unloading of such items of laundry requires an additional, comparatively great effort to be exerted by the attendant and considerably increases the time required. These circumstances impede automatic transfer from the spin-drying machine to the next treatment machine.

An attempt has already been made to automate the removal of the items of laundry from the spin-drying machine by only operating the spin-drying drum at a relatively low spin-drying speed so that the items of laundry do not adhere so strongly to the drum wall. To unload the spin-drying drum, the spin-drying machine is tilted toward the end-side unloading opening and the spin-drying drum is either continuously rotated in one direction or rotated to and fro in both directions, specifically at a relatively low speed, in order to detach the items of laundry so that they can then fall out through the downwardly inclined unloading opening. However, this requires a very high outlay on the construction for the spin-drying machine and the pivoting mechanism. The connecting lines all have to be of flexible design. The space required for a spin-drying machine of this type is greater than in the case of a fixed spin-drying machine.

When items of laundry are cleaned, i.e. when the items of laundry are "washed" in a cleaning fluid, which in the following text is called the detergent, the items of laundry are treated in a cleaning machine which is of similar design to a washing machine or a washer-dryer, i.e. in which the drum housing can be closed in a liquidtight manner for the cleaning operation. After the cleaning process is finished, the detergent is removed. However, the items of laundry are still soaked with a considerable amount of the detergent. Since this detergent and its vapors are damaging to health, the detergent has first to be completely removed from the items of laundry before the cleaning machine may be opened and the items of laundry can be removed and supplied to other stations for further treatment. In general, some of the detergent remaining is removed by a spin-drying process. In this case, however, the spin-drying speed selected cannot be very high because of the the [sic] susceptibility of some types of laundry to crease. The portion of detergent which is still present after this process is removed by a drying process by a circulating airflow being passed through the cleaning machine, from which airflow the liquid and vaporous portions of detergent can be taken off in a downstream condenser and/or an absorption filter.

Since the cleaning machine primarily serves to clean the items of laundry in a liquid bath, the detergent, it is, similarly to a washing machine, of very compact construction, i.e. the operating drum and the drum housing have a relatively small void volume so that a large amount of detergent does not have to be used for a cleaning process. For the drying of the items of laundry after the spin-drying process, the small void volume of the operating drum is of disadvantage because the items of laundry can only separate to a small extent therein. Accordingly, the drying phase in the cleaning drum is very long, to be precise, is generally markedly longer than the cleaning phase. In addition, even after the detergent has been completely removed, unloading of the cleaning machine is made more difficult because the items of laundry, in their now separated state, fill the interior of the operating drum to a very large extent.

The invention is based on the object of specifying a method and devices in which after a treatment process is finished, the items of laundry can be unloaded from the treatment machine concerned in an easier and more simple manner than before. Another object of the present invention is to overcome the drawbacks of the prior art.

By virtue of the fact that in the washing or washer-drying method according to a first embodiment of the present invention, after the spin-drying process is finished the operating drum is set to a speed which is lower than the spin-drying speed but nevertheless is sufficiently high for the centrifugal force exerted by it on the items of laundry to be greater, by a certain amount, than the force of gravity, the items of laundry furthermore rest against the peripheral wall of the operating drum as they circulate. The door of the end-side unloading opening can therefore be opened without the items of laundry falling out of the unloading opening. The pipe of a suction conveying system can thereby also be connected to the open unloading opening of the drum housing without interference from the items of laundry. If the suction conveying system is activated, either by the suction system itself being switched on or, when the suction conveying system is in operation, by a shut-off member being opened in the pipe, and if then the air inlet opening, which is arranged on the peripheral wall of the drum housing, is additionally opened, there is produced within the drum housing a strong airflow which passes from the air inlet opening through those perforations of the operating drum which rotate precisely past the region of said opening, to the unloading opening and moves into the pipe. As a result, in the region of the air inlet opening a third force acts on the items of laundry situated right there, which force is greater than the excess force between the centrifugal force and the force of gravity, and which thereby detaches these items of laundry from the peripheral wall of the operating drum. As soon as these items of laundry are detached from the operating drum, they are no longer subjected to the centrifugal force but just to the force of gravity and the shearing force of the airflow of the suction conveying system. This airflow conveys the laundry to the unloading opening and into the pipe connected thereto and in the latter conveys it further to a further treatment station connected thereto.

Continuous or intermittent opening, and also opening to a varying extent, of the air inlet opening on the drum housing makes it possible to vary the flow rate of the air flowing in and hence also the flow rate of the detached items of laundry, and thus to take into account the different adhesive capacity of the different types of laundry. In the case of intermittent opening, there is also the possibility of varying the duration of the opening phase and the duration of the closing phase. As a result, it is possible, on the one hand, to optimize the unloading process above all in terms of time and to minimize the energy consumption required for the suction conveying system, and, on the other hand, to ensure that the unloading opening of the drum housing is not blocked by too great a flow rate of the items of laundry.

By virtue of the fact that in the case of the drying method according to a second embodiment of the preset invention or in the case of the separating method according to a third embodiment of the present invention, after the drying process or the separating process is finished, the operating drum is set to a speed which is higher than the speed for drying or separating and which is at least sufficiently high for the centrifugal force exerted by it on the items of laundry to be greater than the force of gravity, the items of laundry can no longer fall from the wall of the operating drum into the interior of the operating drum, as was previously and desirably the case. Instead, the items of laundry place themselves against the inside of the operating drum. The unloading opening of the drum housing can therefore be opened without the items of laundry prematurely falling out. After the pipe is connected and the suction conveying system switched on, it is true that a certain, diffuse airflow is produced within the operating drum. However, this is not sufficiently strong to detach the items of laundry from the peripheral wall of the operating drum counter to the centrifugal force acting on them, as long as the speed of said force is set sufficiently high. The latter is therefore very important because after the drying and separating, the items of laundry are in any case vigorously scattered and separated from each other and therefore provide an airflow with a large application surface. Only after the air inlet opening on the drum housing is opened is there produced, in the region thereof, a targeted airflow whose shearing force is sufficient to exceed the excess force between the centrifugal force and the force of gravity and to detach the items of laundry situated precisely in this region from the peripheral wall of the operating drum and to subsequently convey them to the unloading opening and into the pipe.

By virtue of the fact that in the cleaning method according to a fourth embodiment of the present invention after the cleaning method is finished—the operating drum is set to a speed which is sufficiently high for the centrifugal force exerted by it on the items of laundry to be greater than the force of gravity, the items of laundry place themselves against the drum wall or remain close against the drum wall. After the pipe is connected and the suction conveying system is switched on, the unloading opening of the drum housing can be opened without the items of laundry all passing at the same time into the pipe and blocking the latter, and without liquid or vaporous portions of the detergent still present in the items of laundry being able to pass into the surroundings. Only after the air inlet opening of the circulating-air system is opened is there produced, in the region thereof, a targeted airflow whose shearing force is sufficient to exceed the excess force between the centrifugal force and the force of gravity and to detach the items of laundry situated precisely in this region from the peripheral wall of the operating drum and to subsequently convey them to the unloading opening and into the pipe. This enables the items of laundry, which are still full of detergent, to be conveyed, in an environmentally friendly manner and without causing work for the attendant, pneumatically into a dryer whose relatively large void volume is better suited for the drying process than the cleaning machine itself. The latter can, for its part, be more rapidly used again as a cleaning machine, in the narrow sense of the word, and can thus be operated more economically. In a further embodiment, after the cleaning process is finished, the operating drum can be set to a second operating speed which serves as the spin-drying speed for spin-drying the items of laundry.

By means of a refinement of the method according to a fifth embodiment of the present invention, the first unloading speed has the effect that during the opening of the unloading opening of the drum housing, and during the connection of the pipe, the items of laundry are definitely held fast against the peripheral wall of the operating drum, and the second unloading speed has the effect that the items of laundry then only still rest against the peripheral wall of the operating drum with such a low excess of centrifugal force that the airflow produced in the region of the air inlet opening, after the suction conveying system is switched on, in turn suffices to detach the items of laundry in this region from the operating drum. If, toward the end of the unloading process, the operating drum is additionally set to a third unloading speed whose centrifugal force effect is at most equal to the force of gravity, then the last items of laundry still remaining stuck in the operating drum can also be detached from it in order to be conveyed away by the airflow of the suction conveying system.

By means of a refinement of the method for drying or for separating laundry according to a sixth embodiment of the present invention, secondary airflows, which could unfavorably affect the main airflow for detaching the items of laundry from the operating drum and for conveying them away, are avoided or at least reduced.

A refinement of the method for cleaning according to a seventh embodiment of the present invention also enables the last items of laundry which possibly still remain stuck in the operating drum to be detached from it in order to be conveyed away by the airflow of the suction conveying system.

It is also an object of the present invention to provide a device for unloading items of laundry which includes a spin-dryer or washer-dryer having a perforated operating drum and a drum housing having an end-side unloading opening which can be closed by means of a closure member. The drum housing has an air inlet opening on a peripheral wall. A closure member is also provided by which the air inlet opening of the drum housing can be closed, in an air-tight and water-tight manner, and can be released. The device may include a pipe which can be connected at one end to a suction conveying system and which can be connected at the other end to the unloading opening of the drum housing. A control for the drive of the operating drum is provided, by which the operating drum can be set to at least two speeds, the first speed of which serves as the operating speed for spin-drying the items of laundry, and the second speed of which, as the unloading speed, produces a centrifugal force on the items of laundry which is greater, by a specified amount, than the force of gravitational acceleration.

In the case of a refinement of the devices according to a further embodiment of the present invention, the shearing force of the airflow acts at least approximately in the same direction as the force of gravity. In a refinement according to a further embodiment of the present invention the effect that the items of laundry which are placed away from the unloading opening are first grasped and detached by the airflow and so dead spaces having items of laundry remaining behind are avoided. By virtue of the airflow running approximately diagonally through the interior of the operating drum, the items of laundry are conveyed over the shortest distance to the unloading opening and are conveyed out through the latter. In this case, the swirling motions of the airflow and of the items of laundry entrained therein ensure that even those items of laundry which rest outside the region of the air inlet opening and against the inner wall of the operating drum nearer to the unloading opening are gradually detached and conveyed away.

A refinement according to the present invention enables the unloading process to be mechanized and automated to a large extent.

A further refinement according to the present invention provides a very tightly closing closure member for the unloading opening of the drum housing and is particularly suitable for spin-dryers or washer-dryers. It is a further refinement of the present invention to require only a relatively small installation space for the closure member and also only a very small operating space. Such a refinement, which is primarily suitable for tumble-dryers and separating machines, also makes it possible for the pipe of the suction conveying system to be continuously connected to the unloading opening if the drum housing and the operating drum has [sic] a loading opening on the other end side.

A further aspect of the present invention is to provide, in addition to the unloading opening, which because of the pipe connection of the suction conveying system can only be provided with a limited diameter for fluidic reasons, a substantially larger loading opening through which loading of the machine concerned by hand is made more simple and easy.

A refinement according to another aspect of the present invention has the effect, both in the case of the cleaning machine and also in the case of the tumble-dryer provided with a sliding device as closure member of the unloading opening, or in the case of the correspondingly designed separating machine, that items of laundry which accidentally pass into the connecting duct, which is unavoidable for design reasons, between the inner edge of the unloading opening and the closure member, do not settle there but can slip back again into the operating drum.

In a refinement according to another aspect of the present invention, the opening and closing of the unloading opening can be mechanized and automated. The same is true for a refinement of the devices for connecting and decoupling the pipe of the suction conveying system.

In a further aspect of the present invention to provide a device that makes it possible also to automate the setting of the speeds of the operating drum to the various operating requirements.

A refinement according to a further aspect of the present invention makes it possible, toward the end of the unloading process, for the operating drum to be set to an unloading speed whose centrifugal force acting on the items of laundry is at most equal to the force of gravity, with the result that items of laundry possibly still adhering to the operating drum can become detached from it in order to be conveyed away by the airflow of the suction conveying system.

With a refinement of the dryer or of the separating machine according to another aspect of the present invention, the occurrence of inleaked air during unloading can be avoided or at least reduced.

A refinement of the devices according to another aspect of the present invention also makes it possible to fully automatically control virtually the entire operating sequence of the device concerned.

The invention is explained in more detail in the following text with reference to an exemplary embodiment, illustrated in the drawing, of each of the three treatment machines. In the drawing.

Figure 2:
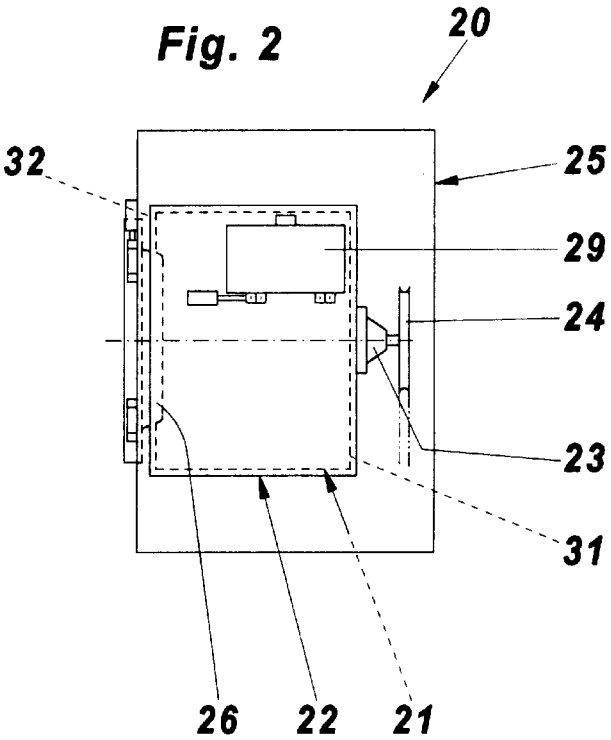
FIG. 2 shows a side view of the washer-dryer with a side wall removed.
Figure 1:
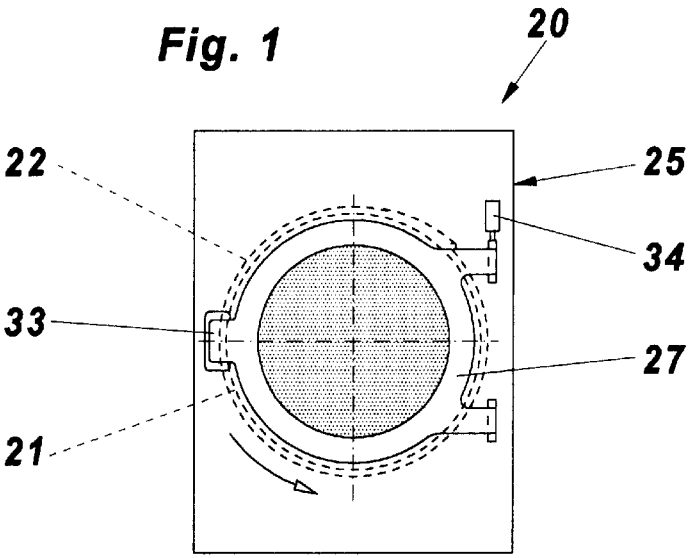
FIG. 1 shows a front view of a washer-dryer.
Figure 3:
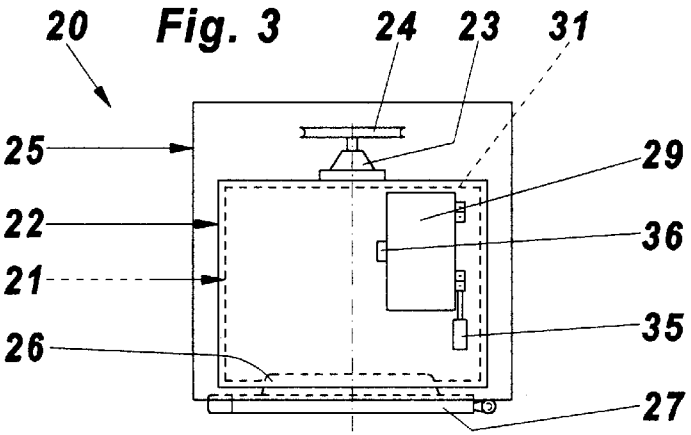
FIG. 3 shows a plan view of the washer-dryer with the top removed.

The washer-dryer 20 which can be seen in FIG. 1 to FIG. 3 has, in the usual manner, a perforated operating drum 21 which is accommodated in the center of a drum housing 22 and is mounted rotably therein by means of a bearing block 23. The drive of the operating drum is indicated by a V-belt pulley 24. All of these parts are accommodated in a box-shaped machine housing 25.

The drum housing 22 has, on its front end side, a circular loading and unloading opening which is only called unloading opening 26 below for short. This unloading opening 26 is closed in the customary manner by a pivoting door 27 and at the same time is secured against water emerging.

Figures 6, 7, 8:
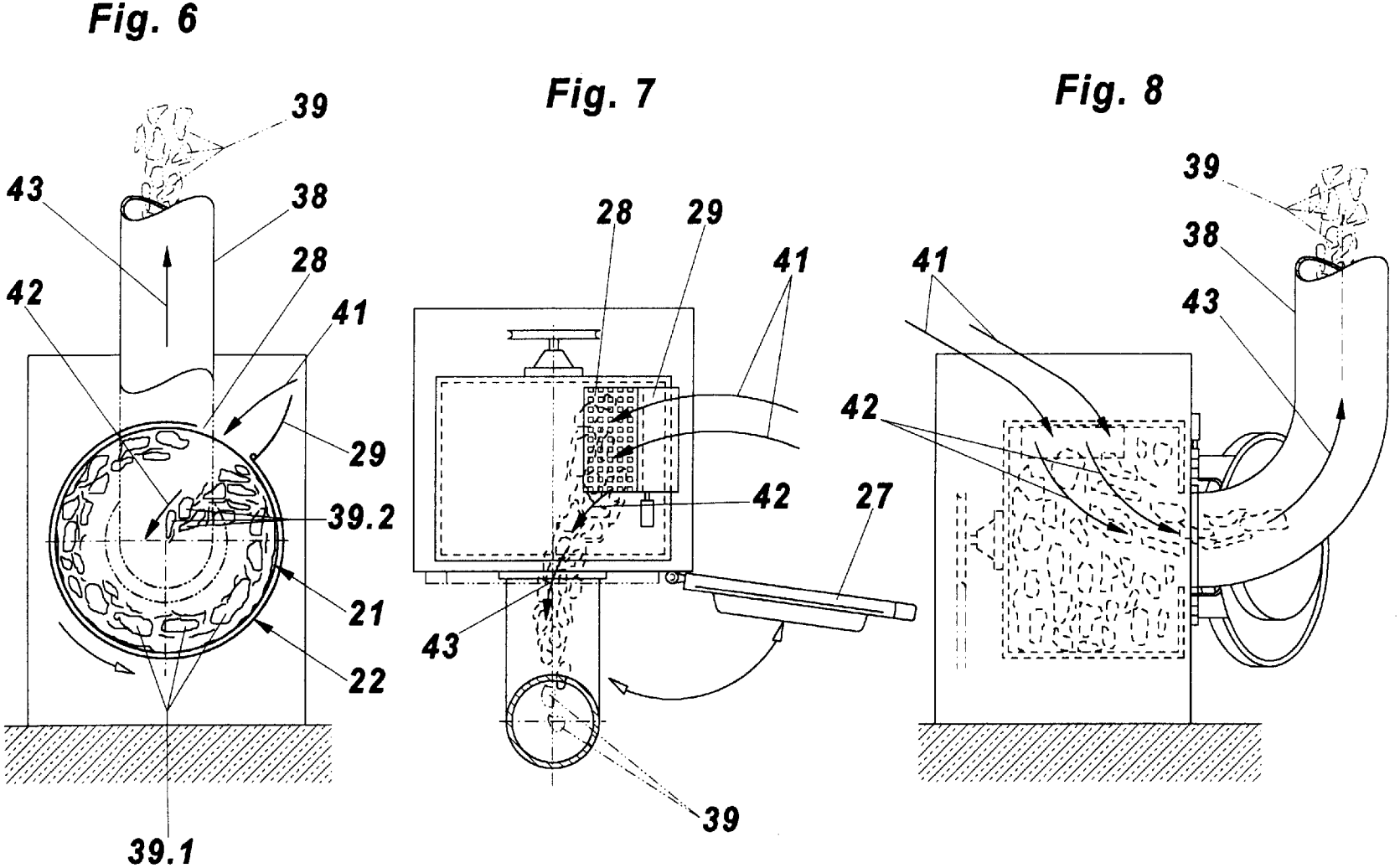
FIG. 6 shows a front view of the washer-dryer with front end walls removed and having a pipe (shown partially) in the unloading operating state.
FIG. 7 shows a plan view of the washer-dryer with the top removed in the same operating state as in FIG. 6.
FIG. 8 shows a side view of the washer-dryer in the same operating state as in FIG. 6 and FIG. 7.

As can be seen in FIG. 6, the drum housing 22 has an air inlet opening 28 which can closed, in an airtight and watertight manner, by means of a closure member in the form of a closure flap 29. The air inlet opening 28 is arranged in the upper part of the drum housing 22, to be precise, in front of the apex line of the drum housing 22 in the direction of the rotational movement of the operating drum 21. In the axial direction, the air inlet opening 28 extends over a longitudinal section of the drum housing, which longitudinal section at least approximately begins at that rear end wall 31 of the operating drum 21 which is remote from the unloading opening 26 and which ends at a specified amount in front of that front end wall 32 of the operating drum 21 which is adjacent to the unloading opening 26 (FIG. 2). In general, the axial extent of the closure flap 29 is somewhat larger than half the axial extent of the drum housing 22.

Figure 4:
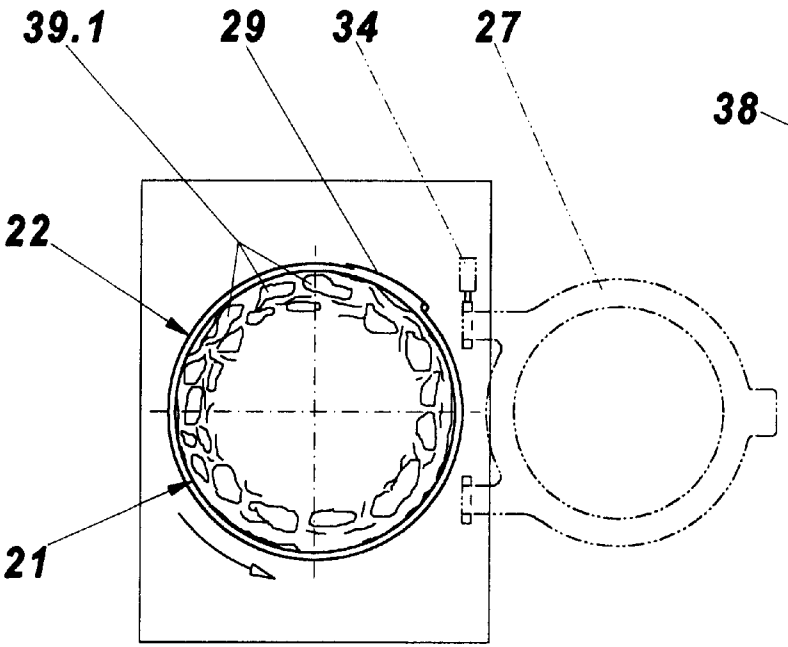
FIG. 4 shows a front view of the washer-dryer with front end walls removed.

The door 27 of the unloading opening 26 is coupled to a locking device 33 by means of which the door 27 can be locked and unlocked mechanically. In addition, the door 27 is coupled to an actuating device 34 by means of which the door 27 can be brought mechanically into the closed position (FIG. 1) and into an open position (FIG. 4).

In a similar manner, the closure flap 29 of the air inlet opening 28 is coupled to an actuating device 35 by means of which the closure flap 29 can be closed and opened, this actuating device 35 expediently being designed in such a manner that the closure flap 29 can be set to different open positions having a different passage cross section. Depending on the type of actuating device 35, it may be expedient also to couple the closure flap 29 to a locking device 36 in order to ensure sufficient tightness of the closure flap 29.

For the unloading, in particular for the fully automatic unloading, of the washer-dryer 20 there is furthermore a suction conveying system 37, of which only the end section of the associated pipe 38 can be seen in FIG. 5 to FIG. 8. Said pipe is connected at a given time to the unloading opening 26 of the drum housing 22. Expediently, for this pipe 38 there is provided a guide device (not shown) by means of which it can be guided to the unloading opening 26 of the drum housing 22 and can be pressed thereon and by means of which the pipe 38 can be guided away from the unloading opening 26 again back into a rest position in which the pipe 38 is situated outside the path of movement of the door 27. It is furthermore expedient to couple the pipe 38 to an actuating device (likewise not shown) which mechanically causes the pipe 38 to be guided toward and pressed onto the unloading opening 26 and to be guided back into its rest position.

The washer-dryer 20 is fitted with a control (not shown) by means of which the drive of the operating drum 21 is switched on and off and is set to a certain speed in the individual operating stages, as is explained in more detail below. In addition, the locking device 33 and the actuating device 34 of the door 27 and also the actuating device 35 and, if appropriate, the locking device 36 of the closure flap 29 of the air inlet opening 27 are switched on and off and, if appropriate, are set to certain positions by this control.

When the pivoting door 27 is opened, the washer-dryer 20 is loaded with items of laundry. After the pivoting door 27 is closed, the washer-dryer 20 is switched on. Its control ensures the automatic operation of the entire washing and spin-drying program, which had previously been set.

In the following, the procedure starts from the fact that the items of laundry, which have already been washed and spun dry, are further processed or treated in other treatment stations, for example, they are dried in a tumble-dryer, in order to be folded and stored somewhat later. For this purpose, the items of laundry have to be unloaded, as automatically as possible, from the washer-dryer and conveyed further to the next treatment station.

During the spin-drying, the items of laundry 39 (FIG. 4) are pressed against the peripheral wall of the operating drum 21 by the centrifugal force acting on them and in the process are also pressed together, so that they form a relatively compact circular ring which adheres to a varying extent, depending on the type of laundry, to the perforated wall of the operating drum 21. These items of laundry, which are designated by 39.1, also hold together to a certain extent.

To unload these items of laundry 39.1, the operating drum 21 is set by the control to a first unloading speed which is lower than the spin-drying speed but is nevertheless sufficiently high for the centrifugal force acting on the items of laundry 39.1 to be greater, by a specified amount, than the force of gravity. Under the effect of this excess force, the items of laundry 39.1 remain adhering to the peripheral wall of the operating drum 21 even at the vertex of its circulating path.

In this operating state of the operating drum 21, the pivoting door 27 is opened (FIG. 4). As a consequence of the sufficiently high centrifugal force, the items of laundry 39.1 remain in the circular bond and do not fall out of the unloading opening 26 which is now open.

Figure 5:
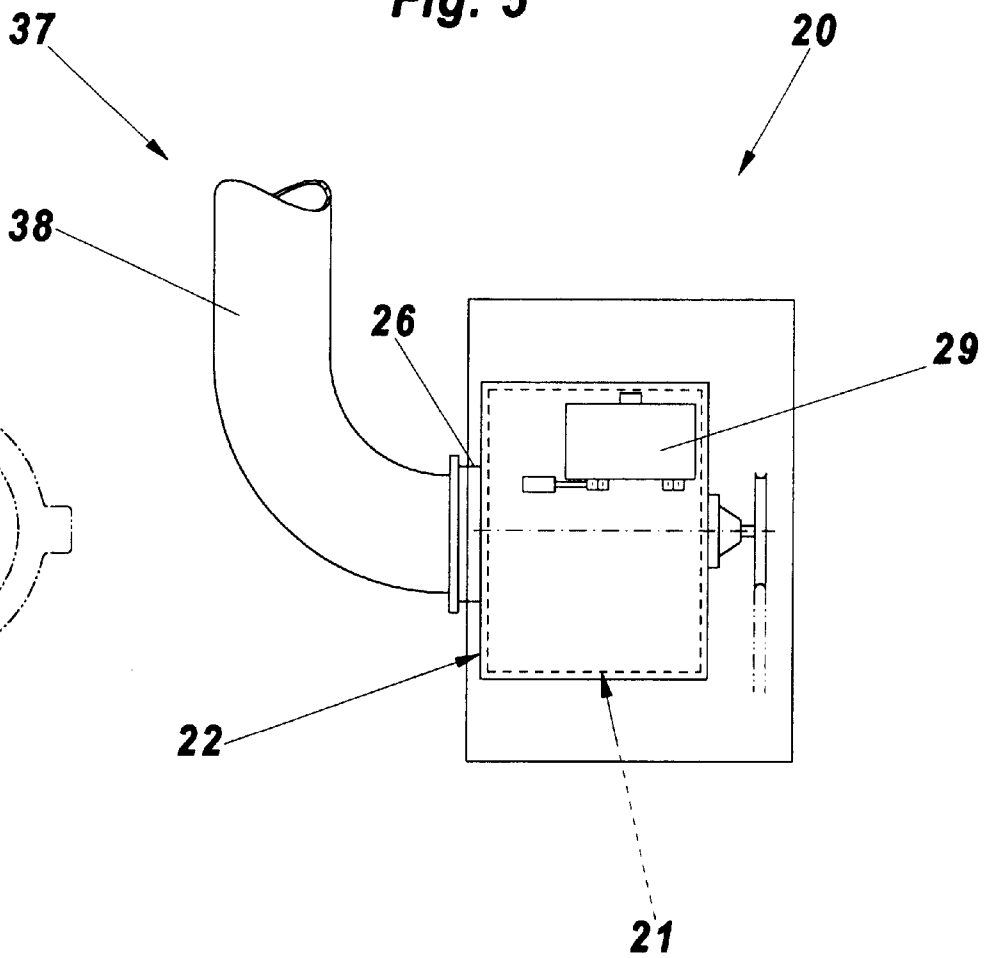
FIG. 5 shows a side view of the washer-dryer with a side wall removed and having a pipe of a suction conveying system connected.

The pipe 38 of the suction conveying system 37 is guided by means of its guide device and actuating device (not shown) up to the unloading opening 26 and is pressed onto the edge thereof (FIG. 5). If the suction conveying system 37 is actuated by it either being switched on or by, in the case of the suction conveying system already being in operation, a shut-off member in the pipe 38 being opened, a vacuum is produced at the unloading opening 26. By means of the control, the closure flap 29 of the air inlet opening 28 of the drum housing 22 is opened (FIG. 6). This takes place either intermittently or continuously, it being possible for the closure flap 29 to be set to an air inlet cross section which is of differing size and which additionally can also be varied. As a consequence of the vacuum produced in the operating drum 21 by the suction conveying system 37, air from the surroundings flows through the air inlet opening 28 into the drum housing 22 and further through the perforations in the operating drum 21 into the interior thereof, as is shown in FIG. 6 by the arrow 41. In the process, there is produced in the region of the air inlet opening 28 an airflow whose shearing force is sufficiently great that it exceeds the excess force between the centrifugal force and the force of gravity and, as a result, detaches the items of laundry 39.2 situated in the region of the air inlet opening 28 from the wall of the operating drum 21 and thereby removes them from the circular bond of the items of laundry 39.1 resting on the drum, and conveys them to the unloading opening 26 and subsequently into the pipe 38, as is shown in FIG. 6 to FIG. 8 by the arrows 42 and 43.

When the items of laundry 39.2 are being detached in the region of the air inlet opening 28 and on their way to the unloading opening 26, at least some of the detached items of laundry also scrape along those items of laundry which are still resting, in the same meridian plane, nearer to the front end wall 32 of the operating drum 21, against the peripheral wall thereof, and likewise detach these items of laundry from the operating drum. This entraining effect is further assisted by the items of laundry 39.1 at least partially overlapping one another in their circular bond and the detached items of laundry 39.2 therefore at least separate those items of laundry which rest on them or are wound around them to a greater or lesser extent. It is therefore very important for the control to match the first unloading speed and the strength of the airflow flowing in through the air inlet opening 28 to one another in such a manner that the amount of items of laundry detached at the same time is not so great that the unloading opening 26 becomes blocked. However, the matching should also be such that the detaching and conveying away of the items of laundry does not last too long and that thereby an unnecessarily large amount of energy is used, in particular by the suction conveying system, and an unnecessarily long time passes until the unloading process and thus also of the conveying process is finished.

If those items of laundry 39.1 which rest on the front longitudinal section of the operating drum 21 are not sufficiently separated and then detached and entrained by those items of laundry 39.2 which are already detached and are scraping by, this strongly depending on the type of laundry, it is then expedient to set the operating drum 21, toward the end of the unloading process, to a second unloading speed which produces a centrifugal force on the items of laundry 39.1 which is at most equal to, better even somewhat smaller than, the force of gravity. The detaching of these items of laundry 39.1 by the force of gravity which then predominates, at least in the region of the vertex, is then facilitated, with the result that these items of laundry can also be unloaded.

Figure 10:
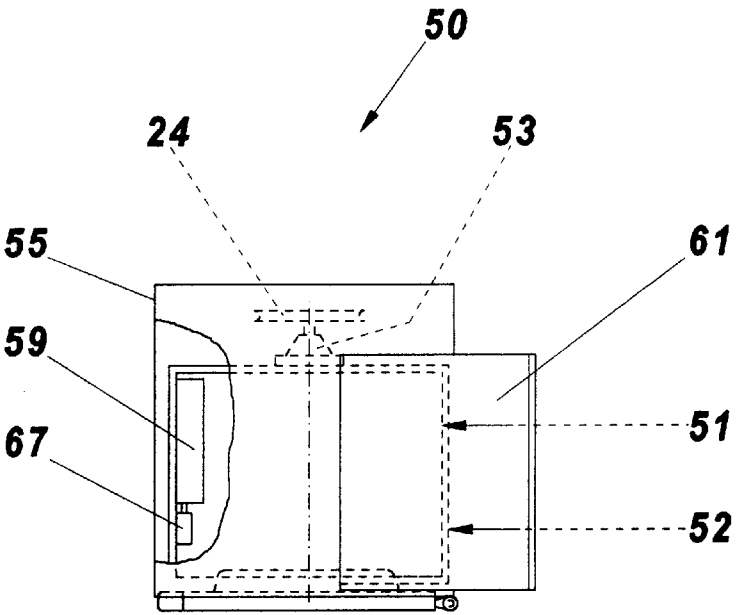
FIG. 10 shows a plan view of the tumble-dryer with the top removed.

The tumble-dryer 50 which can be seen in FIG. 9 to FIG. 13 has, in the usual manner, a perforated operating drum 51 which is accommodated in a drum housing 52 and is mounted rotatably therein by means of a bearing block 53 (FIG. 10). The drive of the operating drum 51 is indicated by a V-belt pulley 54. All of these parts are accommodated in a box-shaped machine housing 55.

On its front end side, the drum housing 52 has a circular loading and unloading opening which is only called an unloading opening 56 below for short. This unloading opening 56 is closed in the customary manner by a pivoting door 57 which is mounted pivotably on the machine housing 55.

Similarly to the washer-dryer 20, the drum housing 52 has an air inlet opening 58 (FIG. 13) which can be closed by means of a closure member in the form of a closure flap 59. The air inlet opening 58 is basically arranged in the same manner as the air inlet opening 28 of the washer-dryer and so reference is made to the explanation thereof. Independently of the air inlet opening 28, there are further entry and exit openings on the drum housing 52 and also, outside the drum housing 52, there are air-guiding ducts for the drying air, such as, for example, the air inlet duct 61 through which fresh air can be sucked in from the surroundings, which fresh air is subsequently passed through a heating system 62 and heated therein before it is passed via a large air entry opening 63 into the interior of the drum housing 52. From there it can flow through the perforated peripheral wall of the operating drum 51 into the interior thereof. In the air inlet duct 61 there is a closure member in the form of a closure flap 64 by means of which the air inlet duct 61 can be closed, if required. The closure flap 64 is coupled to an actuating device (not shown).

The other parts for the circulation of the drying air are of a conventional type. They are not explained in more detail here.

Figure 11:
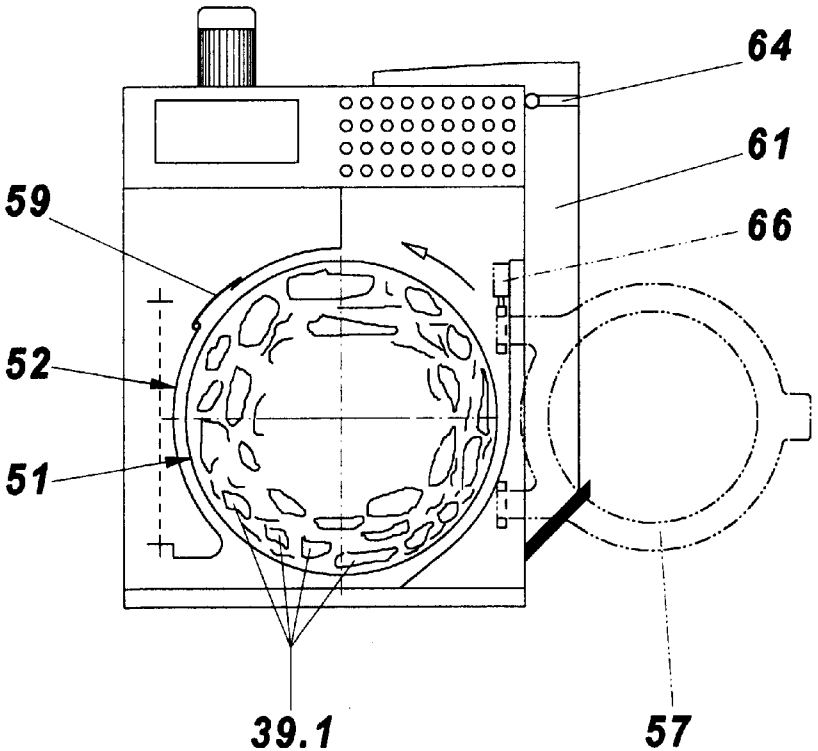
FIG. 11 shows a front view of the tumble-dryer with front end walls removed in an operating state between drying and unloading.
Figure 14:
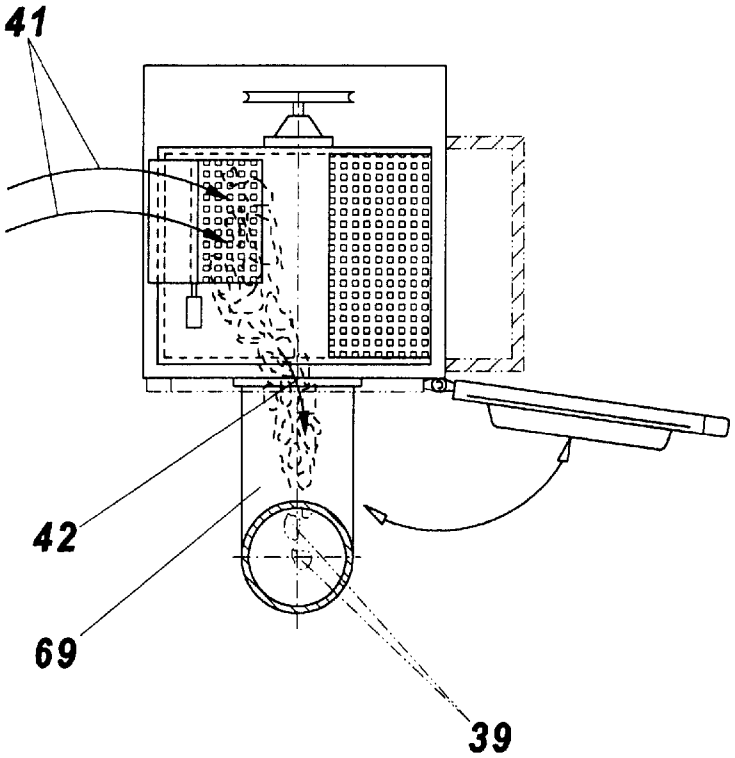
FIG. 14 shows a plan view of the tumble-dryer with the upper part removed in the same operating state as in FIG. 13.

The pivoting door 57 of the unloading opening 56 is coupled to a locking device 65 by means of which the door 57 can be locked and unlocked mechanically. In addition, the door 57 is coupled to an actuating device 66 by means of which the door 57 can be brought mechanically into the closed position (FIG. 9) and into an open position (FIG. 11).

In a similar manner the closure flap 59 of the air inlet opening 58 is coupled to an actuating device 67 by means of which the closure flap 59 can be closed and opened, the actuating device 67 here also being designed in such a manner that the closure flap 59 can be set to various open positions having a different passage cross section.

Figure 12:
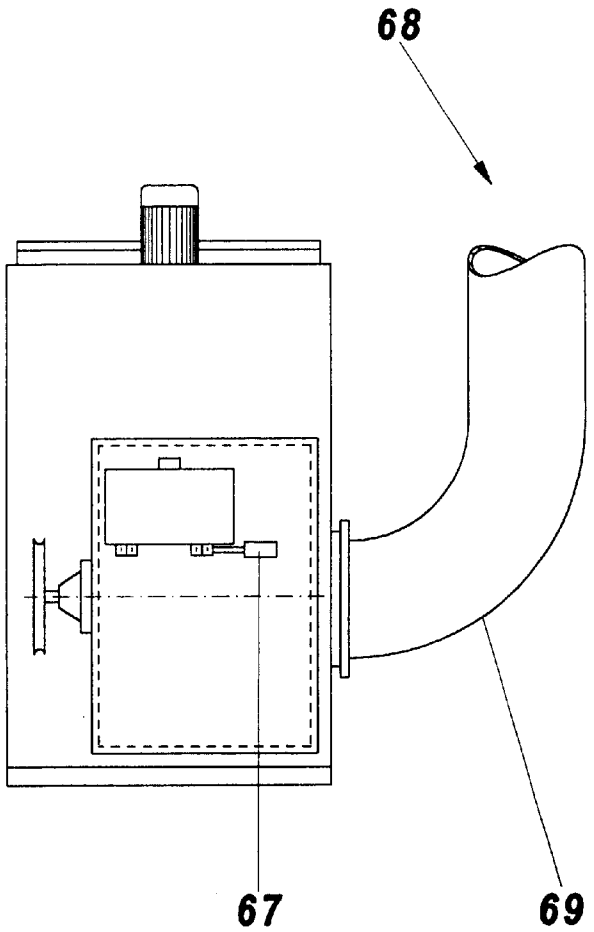
FIG. 12 shows a side view of the tumble-dryer with a side wall removed and with a pipe of a suction conveying system connected.
Figure 13:
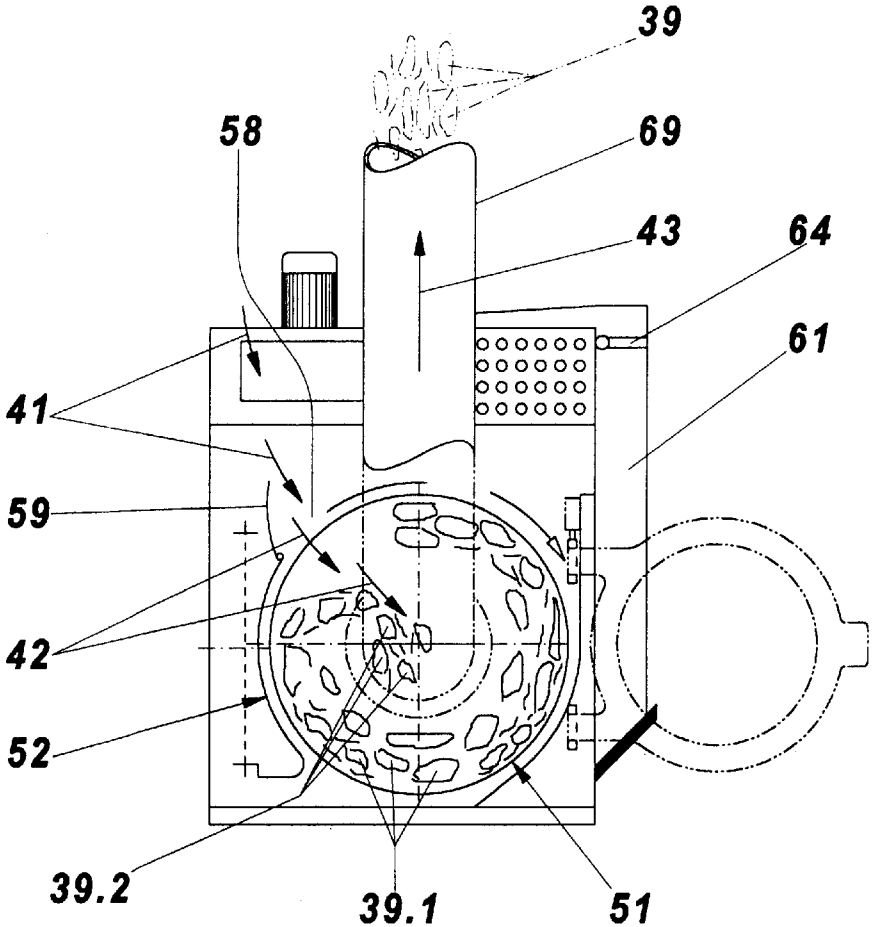
FIG. 13 shows a front view of the tumble-dryer with front end walls removed in the unloading operating state.
Figures 15, 16, 17:
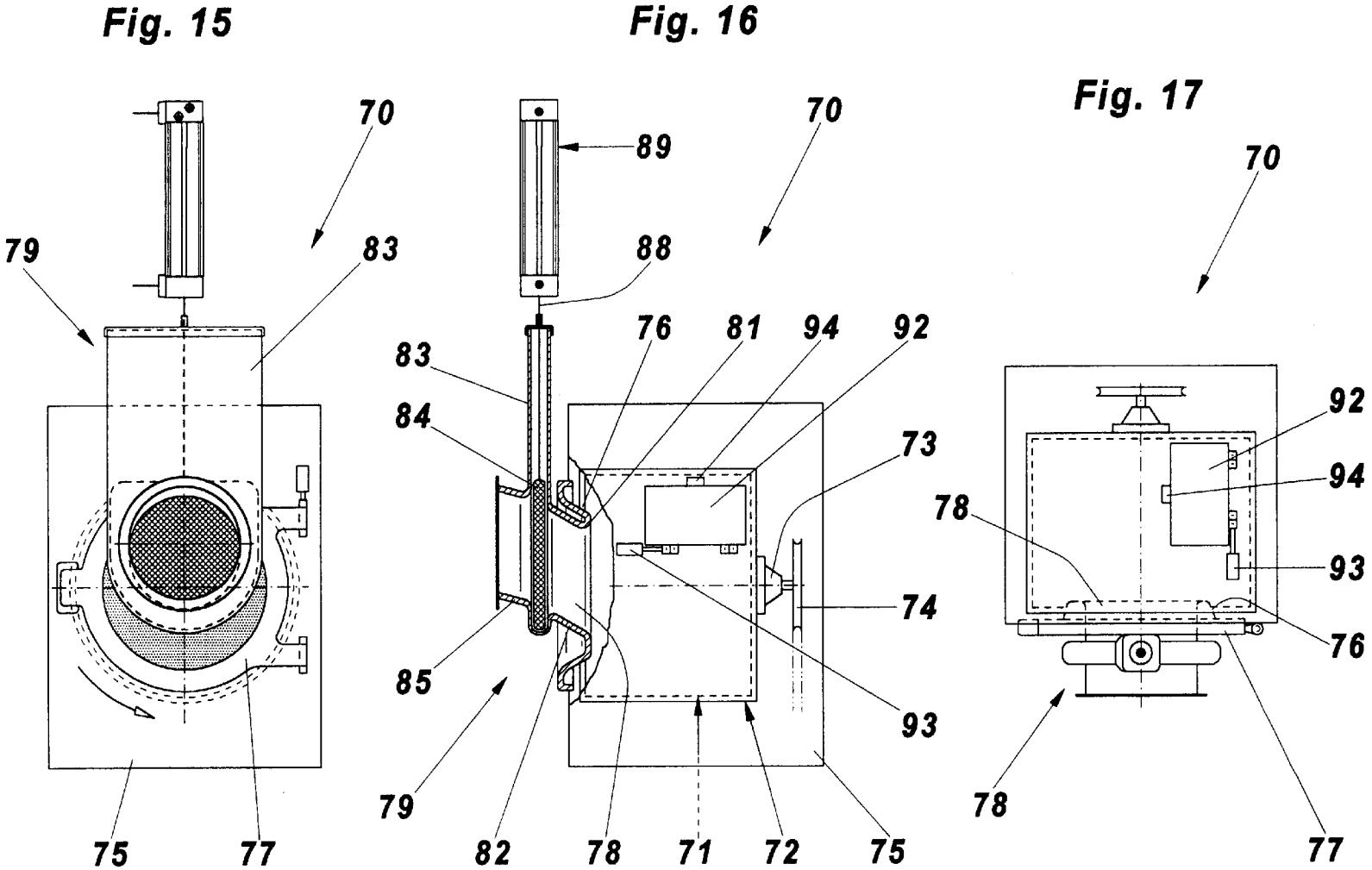
FIG. 15 shows a front view of a cleaning machine.
FIG. 16 shows a partially cut-away side view of the cleaning machine.
FIG. 17 shows a plan view of the cleaning machine with the top removed.

For the unloading, in particular for the fully automatic unloading, of the tumble-dryer 50 there is furthermore a suction conveying system 68, of which only the end section of the associated pipe 69 can be seen in FIG. 12 to FIG. 13. This pipe is connected at a given time to the unloading opening 56 of the drum housing 51, the procedure starting from the fact that this pipe 69 is provided in the same or at least a similar manner with a guide device and an actuating device, as has been explained in conjunction with the washer-dryer 20.

The tumble-dryer 50 is also provided with a control which is not shown in FIG. 9 to FIG. 14 and which partly acts in the same manner and partly in a similar manner to the control device of the washer-dryer 20.

With the pivoting door 57 opened, the tumble-dryer 50 is loaded with items of laundry 39. After the pivoting door 57 is closed, the tumble-dryer 50 is switched on. Its control ensures the automatic operation of the entire drying program which had been set beforehand.

Figure 9:
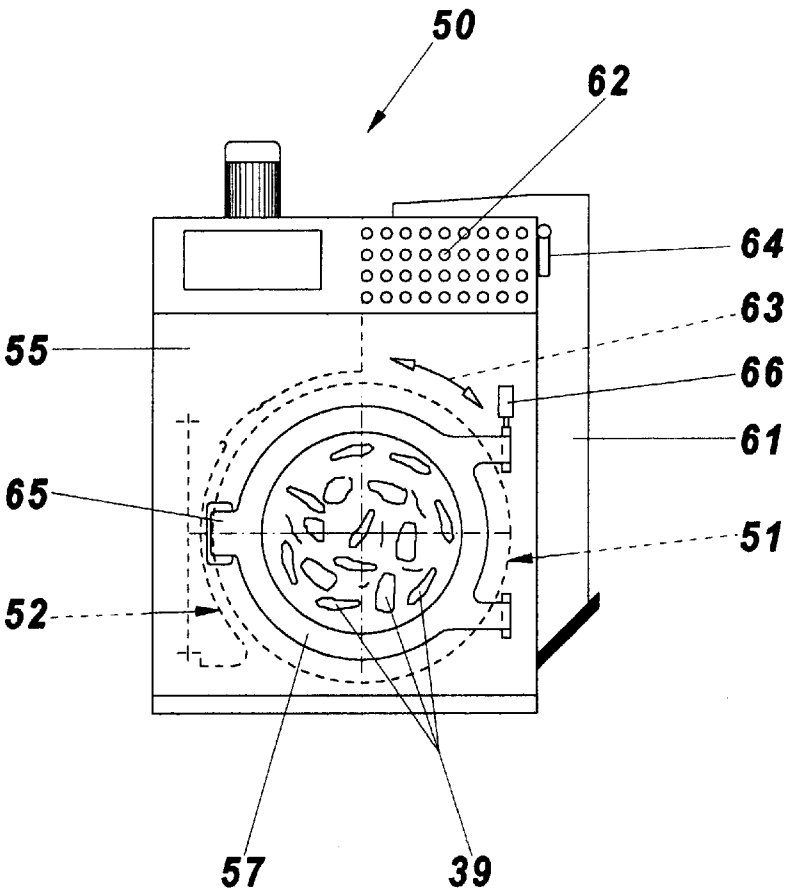
FIG. 9 shows a front view of a tumble-dryer in the drying operating state.

During the drying process the items of laundry 39 are circulated in the operating drum 51 and are dried by the drying air wafting through. In the process, the items of laundry are separated and scattered to a large extent. During the drying the operating speed of the operating drum 51 is sufficiently low for it to be possible, at least toward the end of the drying process, for the separated and scattered items of laundry 39 to become detached from the wall of the operating drum 51 and for them to fall through the interior, through which the drying air flows, of the operating drum 51 if they have been lifted up to a certain extent by carrier ridges on the inside of the operating drum 51. The separated and scattered items of laundry 39 thereby virtually fill the entire interior of the operating drum 51, as is shown in FIG. 9.

To unload these items of laundry 39, the operating drum 51 is set by the control to a first unloading speed which is higher than the operating speed during drying. This first unloading speed is sufficiently high for the centrifugal force acting on the items of laundry 39 to be greater, by a specifiable amount, than the force of gravity and, as a result, the previously freely moving items of laundry 39 now place themselves against the peripheral wall of the operating drum 51 in a loose, circular bond, as items of laundry 39.1, as is shown in FIG. 11.

In this operating state of the tumble-dryer 50, the pivoting door 57 is opened (FIG. 11). As a result of the sufficiently high centrifugal force, the items of laundry 39.1 remain in the circular bond and do not fall out of the unloading opening which is now open.

The pipe 69 of the suction conveying system 68 is guided by means of its guide device and actuating device (not shown) up to the unloading opening 56 and is pressed onto its edge (FIG. 12). The air entry and air exit openings used in the drying process are closed, as is shown using the example of the closure flap 64 in the air inlet duct 61 (FIG. 11).

Before or after the suction conveying system 68 is activated, the operating drum 51 is expediently set to a second unloading speed in which the force excess of the centrifugal force over the force of gravity is smaller than in the case of the first unloading speed, but which nevertheless is so large that, when the closure flap 59 on the air inlet opening 58 is subsequently opened, the items of laundry 39.1 are not detached in a relatively great amount from the peripheral wall of the operating drum 51 and conveyed to the unloading opening 56 and block the latter. Otherwise, reference is made to the explanations for the unloading process in the case of the washer-dryer 20. That also includes the information that it may be expedient to set the operating drum 51, toward the end of the unloading process, to a further, a third unloading speed at which the centrifugal force is smaller than the force of gravity, in order also to detach the last items of laundry 39 and to convey them away.

A separating machine is used to separate the laundry bundles, which have been pressed in a press and have thereby been freed from a large portion of the washing water, so that they can subsequently be further treated. Such separating machines are largely of identical or similar design to a tumble-dryer, with the exception that the air circulated in the separating machine is not heated and therefore only a considerably inferior drying effect occurs. Apart from this, the separating machine is operated and unloaded in the same manner as the previously described tumble-dryer, so that reference can be made to this extent to the preceding explanations with regard to the tumble-dryer 50.

Unlike in the case of a spin-drying machine or a washer-dryer, in the case of tumble-dryers and separating machines the drum housing is not of watertight design. Therefore, a pivoting door which produces a good seal for the drum housing via the customary, flexible rubber collar, is not necessarily required as a closure member for the unloading opening. In the case of a tumble-dryer or a separating machine, as the closure member of the unloading opening use can therefore also be made of a sliding device which without special measures is not necessarily watertight. The sliding-device housing is then generally connected fixedly to the machine housing or to the drum housing. This also results in the possibility of connecting the pipe of the suction conveying system continuously to the sliding-device housing, if the tumble-dryer or the separating machine has its own loading opening on the other end side, because the operating drum is mounted rotatably by means of bearings arranged on the periphery rather than by means of a central bearing block.

The cleaning machine 70 which can be seen in FIG. 15 to FIG. 19 serves to "wash" items of laundry in a cleaning fluid. Since these cleaning fluids, which are called detergents below for short, are generally harmful to health and are environmentally unfriendly, during the cleaning process the cleaning machine has to be completely closed, as is the case for a washer-dryer. After the cleaning process is finished, however, the items of laundry still contain a relatively large amount of detergent. The unloading of these items of laundry from the cleaning machine has therefore to be modified with respect to the unloading process in the case of a washer-dryer. Accordingly, the cleaning machine itself is also partially modified with respect to a washer-dryer, for example, with respect to the washer-dryer 20.

In accordance with the washer-dryer 20, the cleaning machine 70 has a perforated operating drum 71 which is accommodated centrally in a drum housing 72 and is mounted rotatably therein by means of the bearing block 73. The drive of the operating drum 71 is illustrated by the V-belt pulley 74. All of these parts are accommodated in a box-shaped machine housing 75.

On its front end side, the drum housing 72 has a circular loading opening 76. As in the case of the washer-dryer 20, this loading opening is closed by a pivoting door 77 and is at the same time sealed against detergent emerging. Unlike in the case of the washer-dryer 20, the cleaning machine 70 has a separate unloading opening 78 which is arranged on the pivoting door 77, in the central region thereof. This unloading opening 78 is closed and opened by means of a sliding device 79. The sliding device 79 as a whole is continuously connected to the pivoting door 77 and is pivoted together with the latter away from the drum housing 72 when the loading opening 76 is opened in order to load the cleaning machine 70 with items of laundry.

Figure 19:
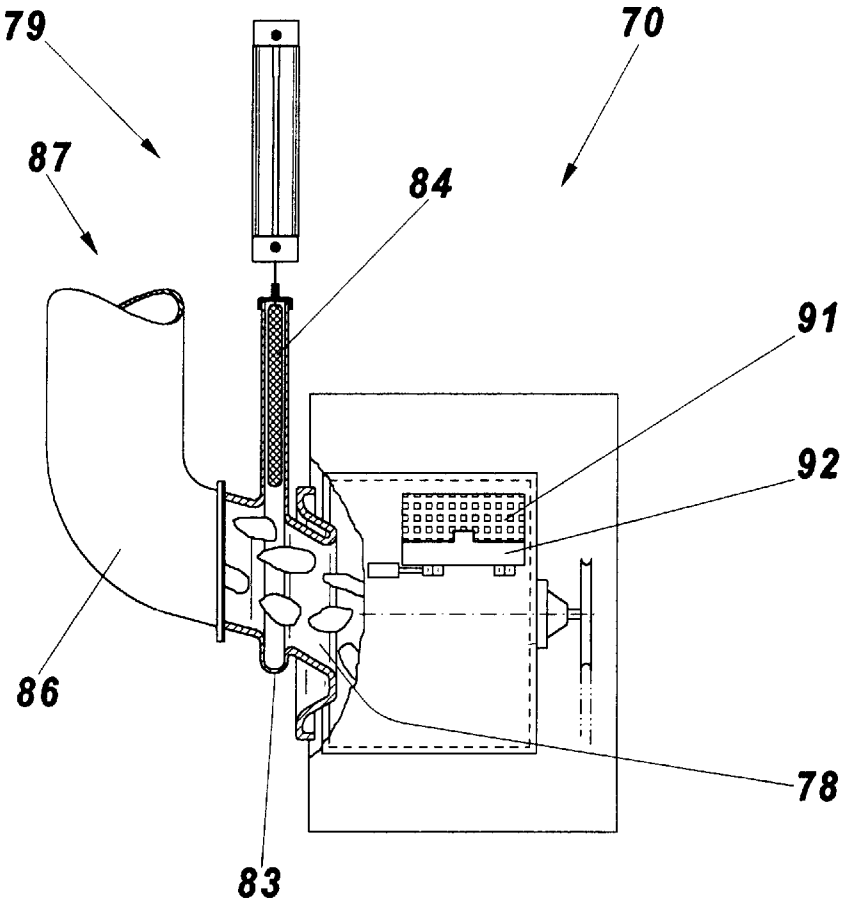
FIG. 19 shows a side view as in FIG. 18 during the unloading process.
Figure 18:
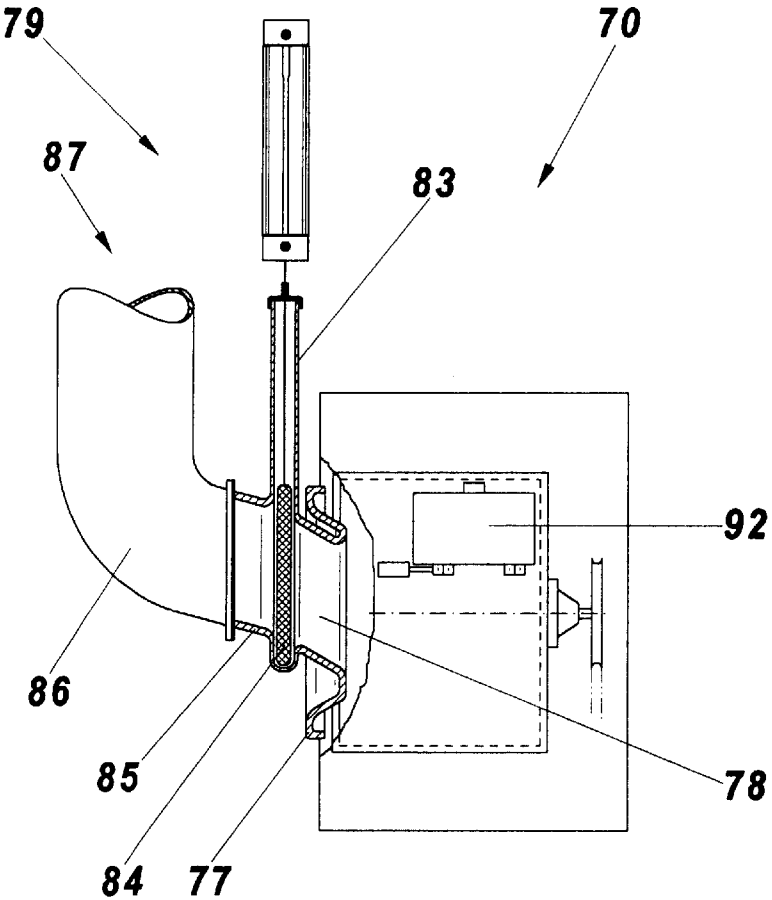
FIG. 18 shows a partially cut-away side view of the cleaning machine with a pipe of a suction conveying system connected, before the unloading process begins.

Since the pivoting door 77 protrudes, with its central part, into the loading opening 76 of the drum housing 72 and only rests on the rubber collar further to the rear, the unloading opening 78 is also situated behind the loading opening 76. In contrast, since the sliding device 79, owing to its relatively large dimensions caused by design, can only be arranged in front of the pivoting door and in front of the front end wall of the machine housing 75, a connecting tube 82 is fitted between the inner edge 81 of the unloading opening 78 and the sliding device 79. The connecting tube has connected to it the sliding-device housing 83 of the sliding device 79 in which the sliding element 84 is guided displaceably between a closed position (FIG. 16 and FIG. 18) and an open position (FIG. 19). The outside of the sliding-device housing 83 has furthermore connected to it a short connecting stub 85 to which the pipe 86 of the suction conveying system 87 is connected (FIG. 18).

The sliding element 84 is actuated via a connecting rod 88 by an actuating device 89 which is designed as a double-acting, pneumatic or hydraulic piston drive. However, it may also be designed as a spindle drive.

As for the washer-dryer 20, in the case of the cleaning machine 70 the drum housing 72 has an air inlet opening 91 which can be closed and opened by means of a closure flap 92. The closure flap 92 is actuated by means of an actuating device 93 and is additionally locked in the closed state by means of a locking device 94.

The connecting duct 82 between the inner edge 81 of the unloading opening 78 and the sliding device 79 rises from the inner edge 81 as far as the sliding device 79 at a certain angle of inclination. As a result, the connecting duct 82 has a downward slope toward the operating drum 71, which downward slope has the effect that items of laundry which accidentally fall out of the operating drum, as it circulates, into the connecting duct 82 automatically slide back into the operating drum again so that they are not eliminated from the circulating movement of the items of laundry in the operating drum 71. The connecting stub 85 on the outside has the same inclination as the connecting duct 82. However, the connecting stub 85 could also be aligned horizontally.

The unloading opening 78 of the cleaning machine 70 is matched to the pipe 86 of the suction conveying system 87. If this unloading opening 78 is also to be sufficiently large for loading the cleaning machine, it is possible to dispense with the pivoting door 77 which is only used to facilitate the loading process because it enables the loading opening to be increased in size. The connecting duct 82 can then be connected directly to the drum housing 72. The unloading opening 78 then simultaneously forms the loading opening of the drum housing and the sliding device 79 forms its closure member. In this case, the control lines and the connecting ducts for the operating means of the actuating device 89 are also simplified.

In the sliding-device housing 83 there is arranged, in the vertical region of the sliding element 84, which is in the closed position, on the outwardly placed side, a press-on device (not shown) which presses the sliding element 84 in the closed position against an annular bearing surface of the sliding-device housing 83, which bearing surface is provided with a sealing element. The sliding device 79 is thereby reliably sealed during the operation of the cleaning system 70.

After the cleaning process is finished, the detergent which is free in the drum housing 72 is removed. However, the items of laundry situated in the operating drum 71 are still soaked with detergent. The amount of detergent remaining in them depends on the type of laundry. In order to reduce the amount of detergent remaining in the items of laundry, a spin-drying process is generally included in which the spin-drying speed, however, is generally lower than the spin-drying speed in a washer-dryer. However, even after such a spin-drying process, the items of laundry still contain a residual amount of detergent. These items of laundry therefore have to be further treated in a closed system, in particular "dried" in order to remove the detergent without leaving a residual so that the items of laundry can then be freely handled. This "drying" of the items of laundry expediently takes place in a dryer which is better suited to the drying process than the cleaning machine 70.

For this purpose, the operating drum 71 is set to a first unloading speed which exerts a centrifugal force on the items of laundry which is greater than the force of gravity. With the sliding device 79 closed as before, the pipe 86 of the suction conveying system 77 is tightly connected to the connecting stub 85 (FIG. 18). With the sliding device 79 closed, the suction conveying system 87 is activated. A vacuum is thereby produced on the outside of the sliding element 84. The press-on device of the sliding element is disconnected. The sliding element 84 is thereby lifted up from its bearing surface on the sliding-device housing 83. The sliding-device 79 is opened by means of the actuating device 79. As a result, at least some of the detergent vapors present in the operating drum 71 are extracted and later collected in a condenser and/or an adsorption [sic] filter.

When the closure flap 92 of the inlet opening 91 is opened an airflow is produced which detaches the items of laundry in the region of the inlet opening 91 from the peripheral wall of the operating drum 71 and conveys them through the unloading opening 78 into the pipe 86. From there they are conveyed into a dryer which is closed to the outside in a similar manner to the cleaning machine 70. In this dryer the items of laundry are "dried", i.e. they are completely freed from the detergent which is then likewise collected in the abovementioned devices.

If the dryer connected downstream of the cleaning machine 70 is of similar design to the tumble-dryer 50, the items of laundry can be unloaded therefrom likewise in a fully automatic manner and supplied to further stations.

What is claimed is:

1. A method for unloading items of laundry from a spin-dryer or washer-dryer having a perforated operating drum and a drum housing with an end-sided unloading opening which can be closed by a door, comprising:

after a spin-drying the items, setting the operating drum to a speed which is lower than the spin-drying speed and which nevertheless is sufficiently high for a centrifugal force acting on the items of laundry to be greater, by a specified amount, than the force of gravity, opening the door of the drum housing, connecting a pipe of a suction conveying system to the unloading opening of the drum housing, activating the suction conveying system, and intermittently or continuously opening, to a varying extent, a closure member of an air inlet opening which is arranged on a peripheral wall on the drum housing.

2. A method for unloading items of laundry from a tumble dryer having a perforated operating drum and a drum housing with an end-side unloading opening which can be closed by a closure member, comprising:

after a drying process, setting the operating drum to a speed which is higher than the speed for drying and which is at least sufficiently high for a centrifugal force acting on the items of laundry to be greater, by a specified amount, than the force of gravity, opening the closure member of the unloading opening of the drum housing, connecting a pipe of a suction conveying system to the unloading opening of the drum housing, activating the suction conveying system, and intermittently or continuously opening, to a varying extent, a closure member of an air inlet opening which is arranged on a peripheral wall on the drum housing.

3. A method for unloading items of laundry from a separating machine for separating compacted laundry bundles, which machine has a perforated operating drum and a drum housing with an end-side unloading opening which can be closed by a closure member, comprising:

after a loosening process, setting the operating drum to a speed which is higher than the speed for separating and which is at least sufficiently high for the centrifugal force acting on the items of laundry to be greater, by a specified amount, than the force of gravity, opening the closure member of the unloading opening of the drum housing, connecting a pipe of a suction conveying system to the unloading opening of the drum housing, activating the suction conveying system, and intermittently or continuously opening, to a varying extent, a closure member of an air inlet opening which is arranged on a peripheral wall on the drum housing.

4. A method for unloading items of laundry from a cleaning machine which has a perforated operating drum and a drum housing with an end-side unloading opening which can be closed by a closure member, comprising:

after a cleaning process, setting the operating drum to a speed which is sufficiently high for a centrifugal force acting on the items of laundry to be greater, by a specified amount, than the force of gravity, connecting a pipe of a suction conveying system to the unloading opening of the drum housing, activating the suction conveying system, opening the closure member of the unloading opening of the drum housing, and intermittently or continuously opening, to a varying extent, a closure member of an air inlet opening which is arranged on a peripheral wall on the drum housing.

5. The method according to claim 4, wherein:

after the cleaning process is finished, the operating drum is set to a second operating speed which serves as the spin-drying speed for spin-drying the items of laundry.

6. The method according to claim 1, wherein:

after the main operating process comprising spin-drying, the operating drum is set to two different speeds, specifically to a first unloading speed, from a time before the closure member of the unloading opening of the drum housing is opened until after the pipe of the suction conveying system is connected, and to a second unloading speed, after the pipe of the suction conveying system is connected until the items of laundry have been unloaded, in the case of the first unloading speed the amount by which the centrifugal force acting on the items of laundry is greater than the force of gravity, is greater than in the case of the second unloading speed, toward the end of the unloading process, the operating drum is set to a third unloading speed which produces a centrifugal force on the items of laundry which is at most equal to the force of gravity.

7. The method according to claim 2, wherein:

at least one intake air ducts and outlet air ducts, which are open during drying and separating, at least one of these ducts is closed before the suction conveying system is switched on.

8. The method according to claim 4, wherein:

toward the end of an unloading process, the operating drum is set to a second unloading speed which produces a centrifugal force on the items of laundry which is at most equal to the force of gravity.

9. A device for unloading items of laundry according to claim 1, comprising:

a spin-dryer or washer-dryer having a perforated operating drum and a drum housing having an end-side unloading opening which can be closed by a closure member, wherein the drum housing has an air inlet opening on a peripheral wall;

a closure member by means of which the air inlet opening of the drum housing can be closed, in an air-tight and water-tight manner, and can be released, a pipe which can be connected at one end to a suction conveying system and which can be connected at the other end to the unloading opening of the drum housing, a control for a drive of the operating drum, by which the operating drum can be set to at least two speeds, the first speed of which serves as an operating speed for spin-drying the items of laundry, and the second speed of which, as the unloading speed, produces a centrifugal force on the items of laundry which is greater, by a specified amount, than the force of gravitational acceleration.

10. The device according to claim 9, wherein:

the air inlet opening is arranged in the upper half of the drum housing, and the air inlet opening is at least partially arranged in front of an apex line of the drum housing in the direction of rotational movement of the operating drum.

11. The device according to claim 10, wherein:

the air inlet opening is completely arranged in front of the apex line of the drum housing in the direction of rotational movement of the operating drum.

12. The device according to claim 9, wherein:

the air inlet opening extends in the axial direction over a longitudinal section of the drum housing which longitudinal section at least approximately begins, at the end wall of the operating drum which is remote from the unloading opening, and wherein the air inlet opening ends by a specified amount in front of the end wall of the operating drum adjacent to the unloading opening.

13. The device according to claim 9, wherein:

the closure member for the air inlet opening on the drum housing is coupled to an actuating device by which the closure member can be adjusted between a closed position and an open position, and wherein the actuating device is designed in such a manner that the closure member can be set to different passage widths.

14. The device according to claim 13, wherein the control is designed such that the actuating device of the closure member of the air inlet opening and/or the locking device and the actuating device for the door or the sliding device of the unloading opening and/or the actuating device for the pipe and/or the actuating device for the shut-off member in the intake air duct and/or the outlet air duct can be switched on and off.

15. The device according to claim 9, wherein:

the closure member for the end-side unloading opening of the drum housing is a pivoting door.

16. The device according to claim 15, wherein the door of the unloading opening is coupled to a locking device by which the door can be locked and unlocked, and the door of the unloading opening is coupled to an actuating device by which the door can be adjusted between a closed position and an open position.

17. The device according to claim 9, wherein the pipe has a guide device, on at least the end section which faces the unloading opening, where the end of the pipe can be guided as far as the unloading opening and can be guided away as far as a rest position lying outside the path of movement of the door of the unloading opening and further comprising an actuating device, by which the end of the pipe can be moved toward the unloading opening, and by which the pipe can be moved into its rest position.

18. The device according to claim 9, wherein the control for the drive of the operating drum is designed in such a manner that the speed of the operating drum can be set to the operating speed and to two different unloading speeds, in the case of the first unloading speed the amount by which the centrifugal force produced on the items of laundry is greater than the force of gravity being greater than in the case of the second unloading speed.

19. The device according to claim 9, wherein the control is designed in such a manner that at the end of the unloading process, the operating drum can be set to a further unloading speed which produces a centrifugal force on the items of laundry, which is at most equal to the force of gravity.

20. A device for unloading items of laundry according to claim 2, comprising:

a tumble-dryer having a perforated operating drum and a drum housing with an end-side unloading opening which can be closed by means of a closure member, wherein the drum housing has an air inlet opening on its peripheral wall;

a closure member by which the air inlet opening of the drum housing can be closed and can be released, a pipe which can be connected at one end to a suction conveying system and which can be connected at the other end to the unloading opening of the drum housing, a control for a drive of the operating drum, by which the operating drum can be set to at least two speeds, the first speed of which serves as an operating speed for drying the items of laundry, and the second speed of which, as the unloading speed, produces a centrifugal force on the items of laundry which is greater, by a specified amount, than the force of gravity.

21. The device according to claim 20, further comprising there is at least one shut-off member in at least one of the intake air duct and outlet air duct used in the main treatment process, and the shut-off member is coupled to an actuating device.

22. A device for unloading items of laundry according to claim 3, comprising:

a separating machine which has a perforated operating drum and a drum housing with an end-side unloading opening which can be closed by a closure member, wherein the drum housing has an air inlet opening on its peripheral wall;

a closure member by which the air inlet opening of the drum housing can be closed and can be released, a pipe which can be connected at one end to a suction conveying system and which can be connected at the other end to the unloading opening of the drum housing, a control for a drive of the operating drum, by which the operating drum can be set to at least two speeds, the first speed of which serves as an operating speed for separating the items of laundry, and the second speed of which, as the unloading speed, produces a centrifugal force on the items of laundry which is greater, by a specified amount, than the force of gravitational acceleration.

23. A device for unloading items of laundry according to claim 4, comprising:

a cleaning machine which has a perforated operating drum and a drum housing with an end-side unloading opening which can be closed by a closure member, wherein the drum housing has an air inlet opening on its peripheral wall;

a closure member by which the air inlet opening of the drum housing can be closed, in a gas-tight and liquid-tight manner, and can be released, a pipe which can be connected at one end to a suction conveying system and which can be connected at the other end to the unloading opening of the drum housing, a control for a drive of the operating drum, by which the operating drum can be set to at least two speeds, the first speed of which serves as an operating speed for cleaning the items of laundry, and the second speed of which, as the unloading speed, produces a centrifugal force on the items of laundry which is greater, by a specified amount, than the force of gravitational acceleration.

24. The device according to claim 23, wherein:

the closure member for the end-side unloading opening of the drum housing is a sliding device.

25. The device according to claim 24, wherein the sliding device is coupled to an actuating device by which the sliding device can be adjusted between a closed position and an open position.

26. The device according to claim 23, wherein:

the drum housing has a loading opening which can be closed by a closure member the closure member of the loading opening is a pivoting door having an unloading opening the closure member of the unloading opening is a sliding device whose sliding-device housing is arranged directly on the pivoting door.

27. The device according to claim 23, further comprising a connecting tube between the inner edge of the unloading opening and its closure member, at least a wall region of the connecting tube rises from the inner edge of the unloading opening as far as the closure member by a specified angle of inclination.

28. A device according to claim 23, wherein:

the drum housing has a loading opening which can be closed by means of a closure member;

the closure member of the loading opening is a pivoting door having an unloading opening therein;

the closure member of the unloading opening is a sliding device whose sliding-device housing is arranged indirectly on a connecting tube connected to the unloading opening on the pivoting door.

29. A device according to claim 27, wherein the entire connecting tube rises from the inner edge of the unloading opening.

* * * * *